US012114714B2

(12) United States Patent
Lai

(10) Patent No.: US 12,114,714 B2
(45) Date of Patent: Oct. 15, 2024

(54) BRA WITH ADJUSTABLE BUILT-IN CUP SPACING

(71) Applicant: Zhenhui Lai, Puning (CN)

(72) Inventor: Zhenhui Lai, Puning (CN)

( * ) Notice: Subject to any disclaimer, the term of this patent is extended or adjusted under 35 U.S.C. 154(b) by 35 days.

(21) Appl. No.: 18/086,025

(22) Filed: Dec. 21, 2022

(65) Prior Publication Data

US 2024/0180265 A1 Jun. 6, 2024

(51) Int. Cl.
*A41C 3/00* (2006.01)

(52) U.S. Cl.
CPC ..... *A41C 3/0028* (2013.01); *A41C 3/0092* (2013.01)

(58) Field of Classification Search
CPC ..... A41C 3/0028; A41C 3/0092
USPC ..... 450/68
See application file for complete search history.

(56) References Cited

U.S. PATENT DOCUMENTS 2,092,390 A * 9/1937 Federico ..... A41C 3/0021 450/60
2,518,975 A * 8/1950 Chisholm ..... A41C 3/00 450/62
2,543,984 A * 3/1951 Panes ..... A41C 3/0028 D2/709
2,624,049 A * 1/1953 Granne ..... A41D 10/00 450/67
6,390,884 B1 * 5/2002 Dragojevic ..... A41C 3/0028 450/71
7,267,599 B2 * 9/2007 Allen ..... A41C 3/0028 450/67
7,517,273 B2 * 4/2009 Wooten ..... A41C 3/0021 450/59
8,177,602 B1 * 5/2012 Kaytes ..... A41C 3/0028 450/60
8,506,350 B1 * 8/2013 Silverman ..... A41C 3/00 450/67
9,226,530 B1 * 1/2016 Silverman ..... A41C 3/0057
9,554,599 B2 * 1/2017 Balland ..... A41C 3/0028
11,641,889 B2 * 5/2023 Eldreth ..... A41C 3/0057 450/1
2014/0259301 A1 * 9/2014 Berns ..... A43C 9/00 2/336
2014/0357158 A1 * 12/2014 Redenius ..... A41C 3/0028 450/60
2017/0055602 A1 * 3/2017 Abraham ..... A41C 3/0057

* cited by examiner

*Primary Examiner* — Gloria M Hale
(74) *Attorney, Agent, or Firm* — Bay State IP, LLC

(57) ABSTRACT

The present disclosure provides a bra with adjustable built-in cup spacing, and relates to the technical field of underwear products. The bra includes a cup main body and a bottom, wherein two built-in cups are arranged in the cup main body, the bottom is an elastic telescopic structure, the bottom is fixedly provided with a rotary button between the two built-in cups, and the rotary button is connected to the two built-in cups in respective through a rope. The technical solution solves the technical problem of poor effects of wearing comfort and stability adjustment when a bra capable of adjusting the size and tightness in the prior art is worn.

9 Claims, 6 Drawing Sheets

BRA WITH ADJUSTABLE BUILT-IN CUP SPACING

CROSS REFERENCE TO RELATED APPLICATION

This application claims the benefit of takes priority from Japanese Utility Model Application No. 2022-004015 filed on Dec. 6, 2022, the contents of which are herein incorporated by reference.

TECHNICAL FIELD

The prevent disclosure relates to the technical field of underwear products, in particular to a bra with adjustable built-in cup spacing.

BACKGROUND

For women, the bra has been become an indispensable clothing of daily wear. The bra can only support the breasts, but also protect the nipples from being injured. The same user has different demands on the bra in different situations. For example, during exercise, activities with different amount of exercise have different requirements on the support force provided to the bra and the breasts, and the vigorous exercise relatively requires a tighter bra to provide greater and more stable support force. Comfort is the primary consideration during the usual wearing process, so a looser bra is required. Or for breast-feeding women, the breasts will change before and after each breast-feeding during the breast-feeding period, the breasts will also change in each month during the pregnant period, and the same is true during the postpartum recovery period. Therefore, a comfortable bra capable of adjusting the size and tightness according to the needs may meet the daily wearing needs of women.

On the existing market, the bra capable of adjusting the size and tightness has poor effects of wearing comfort and stability adjustment, resulting in a non-ideal wearing experience feeling of a user.

SUMMARY

The purpose of the present disclosure is to provide a bra with adjustable built-in cup spacing, so as to solve the technical problem of poor effects of wearing comfort and stability adjustment when a bra capable of adjusting the size and tightness in the prior art is worn. A plurality of technical effects generated by a preferred technical solution in a plurality of technical solution provided by the present disclosure are elaborated below.

In order to implement the above purpose, the present disclosure provides a bra with adjustable built-in cup spacing, including a cup main body and a bottom, wherein two built-in cups are arranged in the cup main body, the bottom is an elastic telescopic structure, the bottom is fixedly provided with a rotary button between the two built-in cups, and the rotary button is connected to the two built-in cups in respective through a rope.

Preferably, the bottom includes a middle fastener and an elastic telescopic belts arranged at two sides of the fastener, and the rotary button is arranged in a middle position of the fastener.

Preferably, an ornament is arranged at a bottom angle adjacent to the two built-in cups, and the rope passes through the ornament and is movably connected to the two built-in cups.

Preferably, the bra further includes side wings, and the cup main body and the bottom are arranged between two end parts of the side wings.

Preferably, a main decorative layer is arranged outside the cup main body, a liner is arranged inside the cup main body, and the main decorative layer includes a middle decorative portion and a side decorative portion.

Preferably, a bottom decorative layer is arranged on a surface of the bottom, and a rotary knob operation portion of the rotary button is located outside the bottom decorative layer.

Preferably, the side decorative portion is made of elastic materials, and arranged at two sides of the cup main body.

Preferably, the middle decorative portion and the bottom decorative layer are all made of lace materials, and the middle decorative portion covers the surface of the cup main body and is located at a lower layer of the side decorative portion.

Preferably, rear sides of the side wings are connected through back buttons.

Preferably, the side wings are elastic structures connected integrally.

The technical solution provided by present disclosure may include the following beneficial effects:

1. In the present disclosure, the elastic bottom is arranged, the rotary button for adjusting the built-in cup spacing is arranged on the elastic bottom, on the one hand, the contact between the rotary button and the human body is isolated through the elastic bottom, and the elastic bottom has a certain thickness and flexibility, so the user will not feel uncomfortable due to the existence of the rotary button: and on the other hand, the elastic structure of the elastic bottom may provide elastic space with stable shrinkage for adjusting the built-in cup spacing, the rotary button is stably fixed on the bottom at the same time and connected to the built-in cup through the rope, with stable structure and convenient adjustment.
2. In the present disclosure, the spacing between the built-in cups may be adjusted by adjusting the rotary button, thereby achieving the effect of adjusting the tightness of the bra: and the adjusting distance is subjected to the feeling of the user, the adjustment is every convenient, and the adjusting distance is the random distance adjustment within an adjustable scope.
3. The present disclosure provides the bra with comfortable wearing and adjustable built-in cup spacing, so as to provide a wearing comfort during the breast-feeding period. During engorgement, the pain may be relieved by widening the cup spacing: and during the postpartum recovery, the cup may be tightened properly to help breast shape recovery, and the bra is suitable for women in various stages from pregnancy to breast-feeding.
4. In the present disclosure, the bra is comfortable with adjustable size. During exercise, the tightness of the bra may be adjusted by adjusting the cup spacing, so as to adjust the support force of the bra on the breasts, and women are convenient to wear the bra in daily life or during exercise.

Thus, the technical solution solves the technical problem of poor effects of wearing comfort and stability adjustment when the bra capable of adjusting the size and tightness in the prior art is worn.

The characteristics and advantages of the present disclosure will be explained in details through the embodiments and in combination with the drawings.

BRIEF DESCRIPTION OF THE DRAWINGS

To better clarify the embodiment of the present disclosure or the technical solution in the prior art, the drawings required to illustrate the embodiments or the prior art will be simply described below. It is apparent that the drawings described below merely illustrate some embodiments of the present disclosure. Those ordinarily skilled in the art can obtain other drawings without creative labor on the basis of those drawings.

Figure 1:
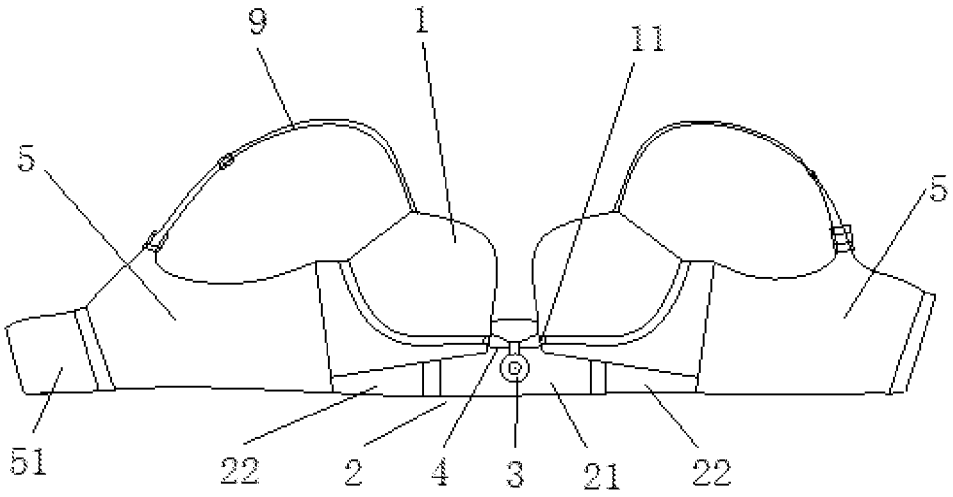
FIG. 1 is a schematic diagram of an internal structure of a front side of a bra with adjustable built-in cup spacing in one embodiment of the present disclosure.

In the drawings: 1. Built-in cup, 11. Ornament, 2. Bottom, 21. Fastener, 22. Elastic telescopic belt, 3. Rotary button, 4. Rope, 5. Side wing, 51. Back button, 6. Main decorative layer, 61. Middle decorative portion, 62. Side decorative portion, 7. Bottom decorative layer, 8. Liner, 9. Shoulder strap.

DETAILED DESCRIPTION OF THE EMBODIMENTS

In order to make the objectives, technical solution and advantages of the embodiments of the present disclosure clearer, the technical solution of the present disclosure will be described in detail below. It is apparent that the described embodiments are only a part of the embodiments of the present disclosure but not all. Based on the embodiments of the present disclosure, all the other implementation modes obtained by those of ordinary skill in the art on the premise of not contributing creative effort should belong to the protection scope of the present disclosure.

Embodiment 1

Figure 2:
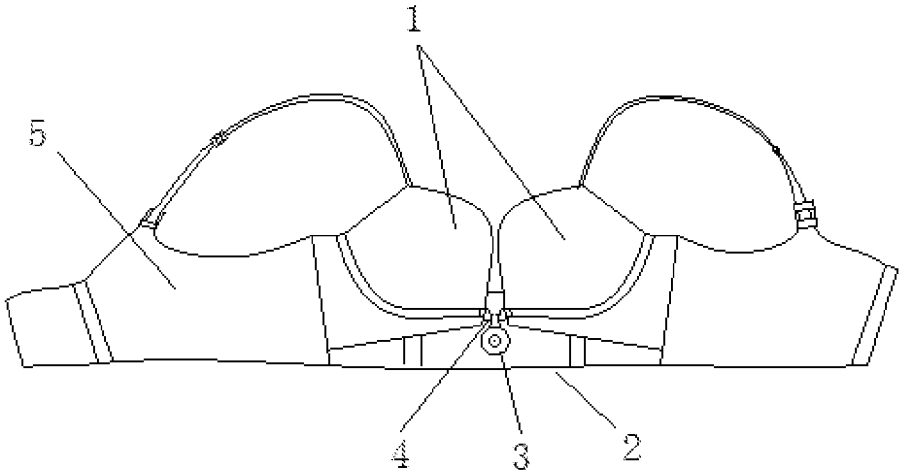
FIG. 2 is a schematic diagram of an internal structure of another front side of a bra with adjustable built-in cup spacing in one embodiment of the present disclosure.
Figure 3:
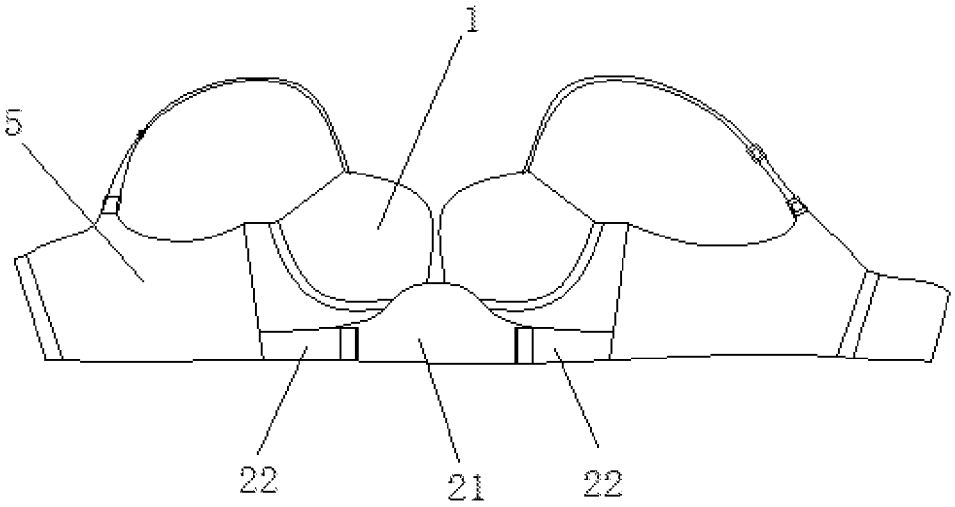
FIG. 3 is a schematic diagram of an internal structure of a rear side of a bra with adjustable built-in cup spacing in one embodiment of the present disclosure.

As daily wearing, the bra can be adjusted in size according to needs so as to provide a comfortable wearing experience: or as a breast-feeding bra, which specifically refers to a bra worn by puerpera during the breast-feeding period, and women need to wear the bra to prevent mastoptosis and relieve breast vibration during walking and exercise, so as to play a role in supporting the breasts and protect the nipples from being injured. During the breast-feeding period, the breasts of the women change greatly and frequently occur engorgement, and the size of the breast changes before and after each breast-feeding during the breast-feeding period: the breasts change greatly during the whole pregnancy and breast-feeding period, the breasts change every month during pregnancy, and the same is true during the postpartum recovery period, and on the existing market, the bra capable of adjusting the size and tightness has poor effects of wearing comfort and stability adjustment, resulting in a non-ideal wearing experience feeling of the user. As shown in FIG. 1 to FIG. 3:

The present disclosure provides a bra with adjustable built-in cup spacing, including a cup main body and a bottom 2, wherein two built-in cups 1 are arranged in the cup main body, the bottom 2 is an elastic telescopic structure, the bottom 2 is fixedly provided with a rotary button 3 between the two built-in cups 1, and the rotary button 3 is connected to the two built-in cups 1 in respective through a rope 4.

The bottom 2 includes a middle fastener 21 and an elastic telescopic belts 22 arranged at two sides of the fastener 21, and the rotary button 3 is arranged in a middle position of the fastener 21.

An ornament 11 is arranged at a bottom angle adjacent to the two built-in cups 1, and the rope 4 passes through the ornament 11 and is movably connected to the two built-in cups 1.

The bra further includes side wings 5, and the cup main body 1 and the bottom 2 are arranged between two end parts of the side wings 5. Rear sides of the side wings 5 are connected through back buttons 51. The side wings adopt the structure setting of the back buttons, so that the bra is convenient to wear and get off, and an adjusting space with a certain setting distance is provided.

When the bra with the adjustable built-in cup spacing provided by the present disclosure is used, the two built-in cups 1 are connected through the rope 4, the length of the rope 4 may be adjusted through the rotary button 3, so as to adjust the distance between the two built-in cups 1. After the bra size is adjusted through the back buttons and the bra is worn, if the user feels poor tightness of the bra in a specific case, the rotary button 3 can be rotated to pull the rope 4, so as to adjust the distance between the two built-in cups 1. As shown in FIG. 1, which is a structural schematic diagram when the distance between the built-in cups is turned up, and as shown in FIG. 2, which is a structural schematic diagram when the distance between the built-in cups is turned down. The effect of adjusting the bra tightness may be achieved by adjusting the distance between the built-in cups, the rotary button 3 is stopped to rotate until the user feels comfortable, and the rotary button 3 is arranged on the elastic bottom 2. On the one hand, the elastic bottom isolates the contact between the rotary button and the human body, the elastic bottom 2 has a certain thickness and flexibility, so the user will not feel uncomfortable due to the existence of the rotary button 3. On the other hand, the elastic structure of the elastic bottom 2 may provide an elastic space with stable shrinkage for the distance adjustment of the built-in cups 1, at the same time the rotary button 3 is stably fixed on the bottom and connected to the built-in cups 1 through the rope 4, with stable structure and convenient adjustment. When the bra with the adjustable built-in cup spacing provided by the present disclosure is worn, the bra does not need to be got off repeatedly for adjustment due to poor wearing tightness. The bra may be adjusted in place in one step by twisting the rotary button 3 after being worn, and with comfortable wearing and simple and convenient operation, the adjustment time for the bra during the wearing process is greatly reduced.

Figure 4:
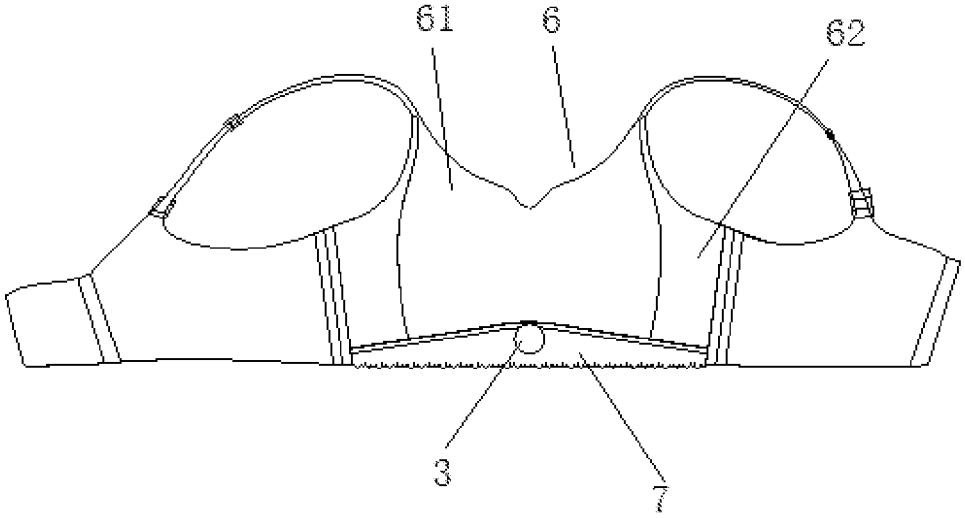
FIG. 4 is a schematic diagram of an external structure of a front side of a bra with adjustable built-in cup spacing in one embodiment of the present disclosure.
Figure 5:
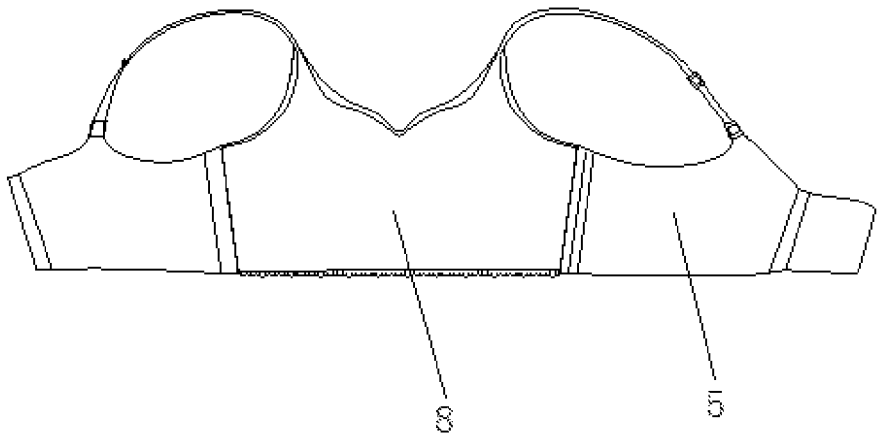
FIG. 5 is a schematic diagram of an external structure of a rear side of a bra with adjustable built-in cup spacing in one embodiment of the present disclosure.

As a further improvement of this embodiment, as shown in FIG. 4 and FIG. 5, a main decorative layer 6 is arranged outside the cup main body 1, a liner 8 is arranged inside the cup main body 1, and the main decorative layer 6 includes a middle decorative portion 61 and a side decorative portion 62. The decorative portion is arranged, so that the bra is comfortable and beautiful during daily wearing.

As a further improvement of this embodiment, a bottom decorative layer 7 is arranged on a surface of the bottom 2, and a rotary knob operation portion of the rotary button 3 is located outside the bottom decorative layer 7. The bottom decorative layer 7 is arranged outside the bottom 2, only the rotary knob operation portion of the rotary button 3 is exposed outside, which can play the decorative and beautiful role on the bra when the user adjusts the rotary button 3.

As a further improvement of this embodiment, the side decorative portion 62 is made of elastic materials, and arranged at two sides of the cup main body. 2 The side decorative portion 62 is arranged at two sides of the cup main body 2: on the one hand, it can play the decorative effect, and on the other hand, a certain support force may be provided to the cup main body from the side, thereby improving the comfortable experience of the user.

As a further improvement of this embodiment, the middle decorative portion 61 and the bottom decorative layer 7 are all made of lace materials, and the middle decorative portion 61 covers the surface of the cup main body 1 and is located at a lower layer of the side decorative portion 62. Due to the setting of the lace material, the bra is comfortable and beautiful and provides good permeability.

Embodiment 2

The bra can play a role in supporting and protecting the female breasts during exercise. However, the sports bra on the market achieves the purpose of reducing the up and down shaking of the female breasts during exercise as far as possible in a manner that the breasts are close to the female trunk as far as possible. However, with the continuous development of technology, people have found that not only the excessive up and down shaking may damage the mammary tissue, but also the long-time excessive breast oppression during the exercise may also damage the mammary tissue. Therefore, a bra capable of adjusting the size and the tightness according to the needs, providing a certain support force and being worn comfortably during the exercise is required, so as to meet the needs during female exercise.

As shown in FIG. 1 to FIG. 5, the present disclosure provides a bra with adjustable built-in cup spacing, including a cup main body and a bottom 2, wherein two built-in cups 1 are arranged in the cup main body, the bottom 2 is an elastic telescopic structure, the bottom 2 is fixedly provided with a rotary button 3 between the two built-in cups 1, and the rotary button 3 is connected to the two built-in cups 1 in respective through a rope 4.

The bottom 2 includes a middle fastener 21 and an elastic telescopic belts 22 arranged at two sides of the fastener 21, and the rotary button 3 is arranged in a middle position of the fastener 21.

An ornament 11 is arranged at a bottom angle adjacent to the two built-in cups 1, and the rope 4 passes through the ornament 11 and is movably connected to the two built-in cups 1.

Figure 6:
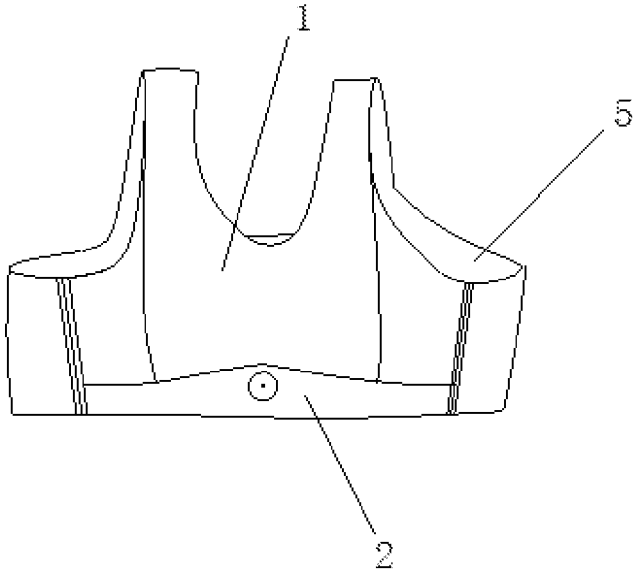
FIG. 6 is a structural schematic diagram of a bra with adjustable built-in cup spacing in another embodiment of the present disclosure.

As shown in FIG. 6, the bra further includes side wings 5, and the cup main body 1 and the bottom 2 are arranged between two end parts of the side wings 5. The side wings 5 are elastic structures connected integrally.

When the bra with the adjustable built-in cup spacing provided by the present disclosure is used, the two built-in cups 1 are connected through the rope 4, the length of the rope 4 may be adjusted through the rotary button 3, so as to adjust the distance between the two built-in cups 1. After the bra is worn, the rotary button 3 can be rotated to pull the rope 4, so as to adjust the distance between the two built-in cups 1 and achieve the purpose of adjusting the bra tightness. The rotary button 3 is arranged on the elastic bottom 2, which has a certain thickness and flexibility, so the bra is more comfortable to be worn, and the elastic bottom is arranged at the lower sides of the built-in cups. When the distance between the built-in cups 1 is adjusted suitably, a certain support force is provided to the built-in cups 1, so that the breasts of the user will not shake up and down and avoid the corresponding injury due to the support force provided by the elastic bottom 2 during the exercise. When being worn and used, the bra with the adjustable built-in cup spacing provided by this embodiment is comfortable and safe to be worn, with convenient adjustment and stable structure.

As a further improvement of this embodiment, a main decorative layer 6 is arranged outside the cup main body 1, a liner 8 is arranged inside the cup main body, and the main decorative layer 6 includes a middle decorative portion 61 and a side decorative portion 62. The decorative portion is arranged, so that the bra is comfortable and beautiful during daily wearing.

As a further improvement of this embodiment, a bottom decorative layer 7 is arranged on a surface of the bottom 2, and a rotary knob operation portion of the rotary button 3 is located outside the bottom decorative layer 7. The bottom decorative layer 7 is arranged outside the bottom 2, only the rotary knob operation portion of the rotary button 3 is exposed outside, which can play the decorative and beautiful role on the bra when the user adjusts the rotary button 3.

As a further improvement of this embodiment, the side decorative portion 62 is made of elastic materials, and arranged at two sides of the cup main body. 2 The side decorative portion 62 is arranged at two sides of the cup main body 2: on the one hand, it can play the decorative effect, and on the other hand, a certain support force may be provided to the cup main body from the side in a concentrated direction, thereby improving the comfortable exercise experience of the user.

The bra with the adjustable built-in cup spacing provided by the present disclosure has a regular bra structure setting according to the needs, such as the setting of the shoulder strap 9, and repetition is not made herein.

In the description of the present disclosure, it is understood that orientation or position relationships indicated by the terms "center, "upper", "lower", "left", "right", "vertical", "horizontal", "inner", "outer" and the like are based on the orientation or position relationships as shown in the drawings, for ease of describing the present disclosure and simplifying the description only, rather than indicating or implying that the mentioned apparatus or element necessarily has a particular orientation and must be constructed and operated in the particular orientation. Therefore, these terms should not be understood as limitations to the present disclosure. In addition, the terms "first", "second" and "third" are merely used for the description purpose, instead of being understood as indicating or implying relative importance.

In the description of the present disclosure, it is also noted that, unless specific regulation and limitation otherwise, terms "install", "join" and "connect" should be generally understood, for example, may a fixed connection, or a detachable connection, or an integrated connection, may a mechanical connection or an electric connection, may a direct connection or an indirect connection through an intermediation, and may an internal connection of two elements. Those of ordinary skill in the art may understand the specific meaning of the terms in the present disclosure according to specific conditions.

In conclusion, the above is only the specific implementation mode of the present disclosure, but the scope of protection of the present disclosure is not limited to this. Those skilled in the art can easily think of changes or replacements within the scope of the technology disclosed in the present disclosure, which shall be covered by the scope of protection of the present disclosure. Therefore, the scope of protection of the present disclosure should be subject to the scope of protection of the appended claims.

What is claimed is:

1. A bra with adjustable built-in cup spacing, comprising a cup main body and a bottom, wherein two built-in cups are arranged in the cup main body;

wherein the bottom is an elastic telescopic structure;

wherein the bottom is fixedly provided with a rotary button between the two built-in cups;

wherein the rotary button is connected to the two built-in cups in respective through a rope;

wherein a main decorative layer is arranged outside the cup main body, wherein the main decorative layer comprises a middle decorative portion and a side decorative portion; and wherein a liner is arranged inside the cup main body.

2. The bra with the adjustable built-in cup spacing according to claim 1, wherein the bottom comprises a middle fastener and elastic telescopic belts arranged, one at each side of the fastener; and wherein the rotary button is fixedly arranged in a middle position of the fastener.

3. The bra with the adjustable built-in cup spacing according to claim 2, wherein an ornament is arranged at a bottom angle adjacent to the two built-in cups, and the rope passes through the ornament and is movably connected to the built-in cups.

4. The bra with the adjustable built-in cup spacing according to claim 3, further comprising side wings, wherein the cup main body and the bottom are arranged between two end parts of the side wings.

5. The bra with the adjustable built-in cup spacing according to claim 1, wherein a bottom decorative layer is arranged on a surface of the bottom, and a rotary knob operation portion of the rotary button is located outside the bottom decorative layer.

6. The bra with the adjustable built-in cup spacing according to claim 5, wherein the side decorative portion is made of elastic materials and wherein the side decorative portion is arranged at two sides of the cup main body.

7. The bra with the adjustable built-in cup spacing according to claim 6, wherein the middle decorative portion and the bottom decorative layer are all made of lace materials, and the middle decorative portion covers the surface of the cup main body and is located at a lower layer of the side decorative portion.

8. The bra with the adjustable built-in cup spacing according to claim 1, wherein rear sides of the side wings are connected through back buttons.

9. The bra with the adjustable built-in cup spacing according to claim 1, wherein the side wings are elastic structures connected integrally.

* * * * *